United States Patent [19]

Welsh et al.

[11] 3,933,249

[45] Jan. 20, 1976

[54] PRODUCT SEPARATOR

[75] Inventors: Robert A. Welsh, Bethel Park; Albert W. Deurbrouck, Pittsburgh, both of Pa.

[73] Assignee: The United States of America as represented by the United States Energy Research and Development Administration, Washington, D.C.

[22] Filed: Mar. 26, 1973

[21] Appl. No.: 344,697

[52] U.S. Cl. ..... 209/75; 209/111.6; 209/117; 209/441

[51] Int. Cl.[2] ..... B07C 5/342

[58] Field of Search .... 209/75, 111.6, 111.7, 111.8, 209/111.5, 117, 441, 442, 443

[56] References Cited

UNITED STATES PATENTS

| | | | |
|---|---|---|---|
| 1,513,693 | 10/1924 | Butchart | 209/441 |
| 1,678,884 | 7/1928 | Sweet | 209/111.6 |
| 2,907,459 | 10/1959 | Jean | 209/441 X |
| 3,179,247 | 4/1965 | Hutter et al. | 209/111.7 |
| 3,650,396 | 3/1972 | Gillespie et al. | 209/111.7 |

*Primary Examiner*—Allen N. Knowles

[57] ABSTRACT

A secondary light sensitive photoelectric product separator for use with a primary product separator that concentrates a material so that it is visually distinguishable from adjacent materials. The concentrate separation is accomplished first by feeding the material onto a vibratory inclined surface with a liquid flow, such as a wet concentrating table. Vibrations generally perpendicular to the stream direction of flow cause the concentrate to separate from its mixture according to its color. When the concentrate and its surrounding stream reach the recovery end of the table, a detecting device notes the line of color demarcation and triggers a signal if it differs from a normal condition. If no difference is noted nothing moves on the second separator. However, if a difference is detected in the constant monitoring of the color line's location, a product splitter and recovery unit normally positioned near the color line at the recovery end, moves to a new position. In this manner the selected separated concentrate is recovered at a maximum rate regardless of variations in the flow stream or other conditions present.

11 Claims, 3 Drawing Figures

PRODUCT SEPARATOR

BACKGROUND OF THE INVENTION

1. Field of the Invention

This invention concerns itself with light sensitive separators that distinguish different materials based on their reflected light. In particular, our invention takes a concentrate that has been subjected to a prior primary separating step and further monitors its reflected light to insure a final separation.

2. Description of the Prior Art

Light sensitive cells like photocells have long been used to detect the color of mineral products moving on a surface and to use the detected color to control the actuation of some type of sorting device. The 1928 U.S. Pat. No. 1,678,884 to A. T. Sweet discloses an ore separation device which is based on the color of light reflected from the materials. It also employs a stationary photocell and light source over a moving surface that carries the ore that is being separated. However, the ore is segregated solely on the color characteristics of the reflected light which could mean two rocks of different ore but closely resembling each other in color would be grouped together. Our invention overcomes this apparent type of possible error based solely on the detected color, by combining a mobile photocell detector and separator with a primary separator which has previous separated and concentrated material according to its make-up. This gives a degree of concentration of the recovered material heretofore available on such a scale.

SUMMARY

The product separating apparatus of the invention has two basic major parts that are combined to give the desired result. The first of these parts is a primary separator, like a wet concentrating table, for example, that concentrates one or more different materials into visually distinguishable zones on the table surface. The second major part is a light sensitive separator. It consists of three major segments namely: a light responsive detector, a control device, and a material splitter. As the light responsive detector monitors the visually distinguishable line between two adjacent zones it signals the control if variation from a normal condition are detected. This moves the splitter to constantly maintain it at a position so that it can constantly divide the concentrate from adjacent materials regardless of system fluctuations.

By keeping the mobile splitter at the proper position variations in feed rate, percent solids, size consistency, and the amount of desired material can be compensated for to a large degree to give a highly concentrated recoverable material at the output.

The principle object of this invention is an improved light sensitive separating apparatus.

A secondary object is such an apparatus usable with a wet concentrating table to constantly give a highly recoverable concentrate.

Personnel of the United States Bureau of Mines invented the preferred embodiment of this invention, described herein, to separate pyrite on a wet concentrating table. In such a case, the pyrite concentrate has been sold as a by-product in a desulfurization of coal process. Prior to this invention it was extremely difficult to hand pick or otherwise separate the pyrite concentrate from its adjacent highly concentrated impurities such as shale and carbonaceous shale. Our invention, as will be described, allowed the recovery of a very concentrated amount of pyrite.

Figure 1:
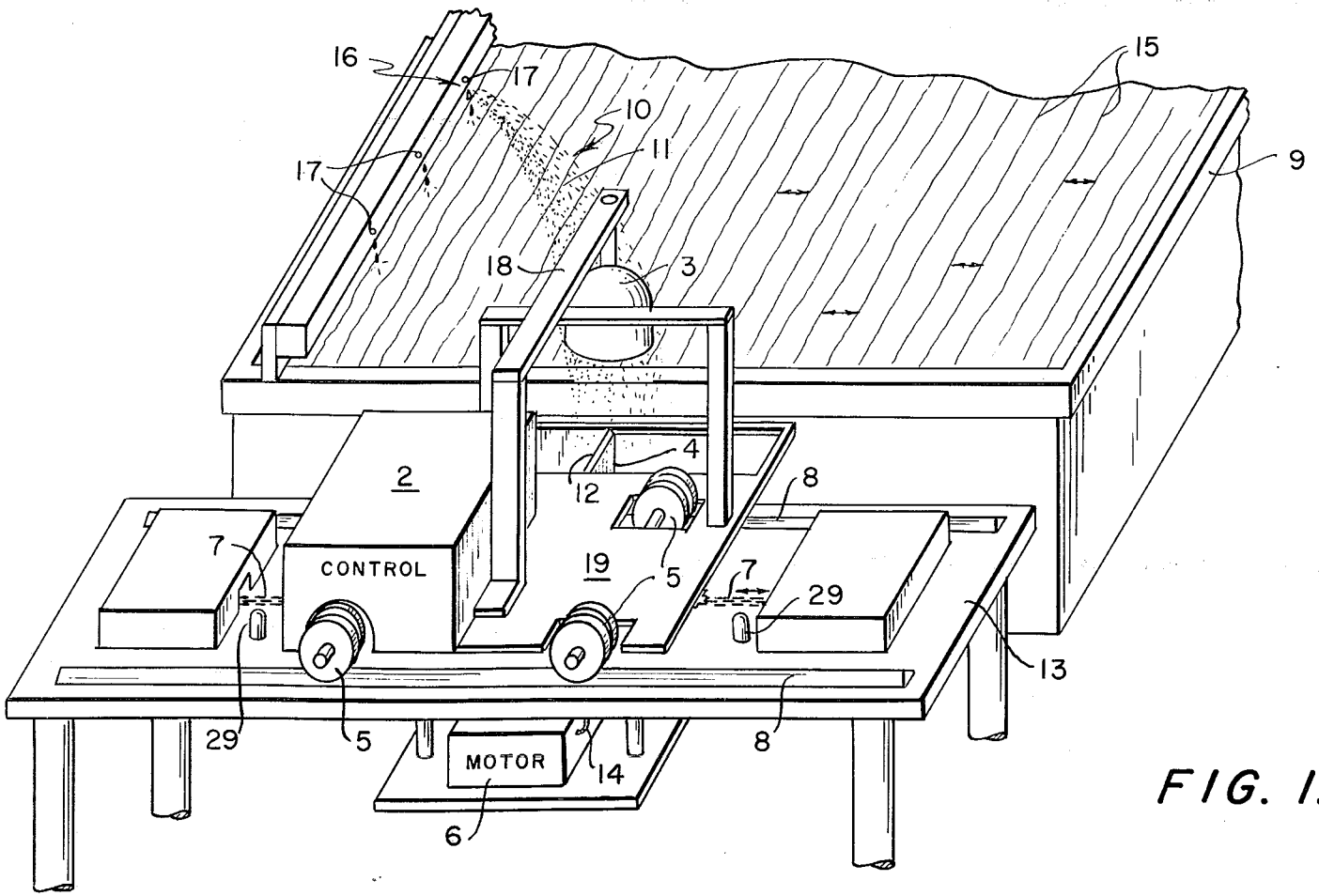
FIG. 1 is a perspective view of the preferred embodiment of our invention.

The light sensitive separator is generally represented by the number 1 in FIG. 1. Its main purpose is to detect visually observable variations in the concentrate and its adjacent zones as it moves in a liquid stream on a surface. This detected data is in turn used to control the movement of a product splitter to insure it remains at the concentrate discharge position at the recovery end. To accomplish these functions, structurally the light sensitive separator may consist of three major subdivisions namely, a control 2, a photocell detector 3, and a mobile product splitter 4. A reversible motor 6 under the direction of the control moves the splitter generally perpendicular to the stream flow of the slurry containing the materials under observation.

Movement may be imparted to the platform 19 in either direction by the drive motor 6 when a signal from the detector 3 is received. When this happens wheels 5 ride in their respective tracks 8 on the table. Four stop and switch members 29, two at the opposite ends of each track, limit the platform movement to constrain the attached detector to a fixed path. A cantilever support structure 18 rigidly interconnects movable platform 19 and detector 3 so that both the control 2 and detector 3 move as a single unit. Chain drive 7 connected to both ends of the platform 19 is moved in either direction by gearing (not shown) actuated by motor 6 depending on the signal received via cable 14 from the control. Parallel to the movable platform is fixed table 13 that supports the tracks on its upper surface and an underlying cage frame for drive motor 6.

Spaced a short distance from table 13 and generally parallel to one of its sides is a wet concentrating table 9. Between these two members mobile material splitter and recovery container 4 moves so that the slurry from the wet table either passes through it or is directed to a larger container for reuse. Table 9 is slightly tilted towards the splitter so that the flow of water at inlets 17 after forming its concentrated slurry moves from feed entrance 16 towards the splitter to its recovery discharge edge. Vibrations generally perpendicular to the direction of the flow stream are imparted by a drive (not shown) to the surface of table 9 so that the material fed at entrance 16 moves (to the right in FIG. 1) over a series of small surface riffles or protrusions 15. These protrusions are parallel elongated members generally facing perpendicular to the material recovery edge of the table. As a heterogeneous mixture of materials enters the table at the entrance it mixes with water to form a slurry. The smaller diameter and less dense particles will move over the protrusions further and further to the right under the vibratory influence eventually forming themselves into distinct color zone areas in the slurry stream. This is what commonly happens on a wet concentrating table and a further explanation is believed unnecessary. The reader is referred to page 246 of the work entitled "a dictionary of mining, mineral, and related terms" put out by the Bureau of Mines, United States Department of the Interior (1968) for more details. In. FIG. 1 the number 10 represents two adjacent color zones of a concentrate and its adjacent slurry formed by the wet liquid stream of water entering at side inlets 17 and the minerals to be separated. Between these color zones an approximate wavy inclined line of demarcation 11 is formed to visually indicate the portion of the table surface occupied by one or more of the different mineral concentrates at a given time. As the mineral feed rate, size of particles, their densities, water input characteristics, percent solids, or operating conditions change, line 11 will fluctuate as the zone of concentration varies. To provide for the monitoring of such fluctuations a detector 3 is placed in a parallel plane over the table 9.

Figure 2:
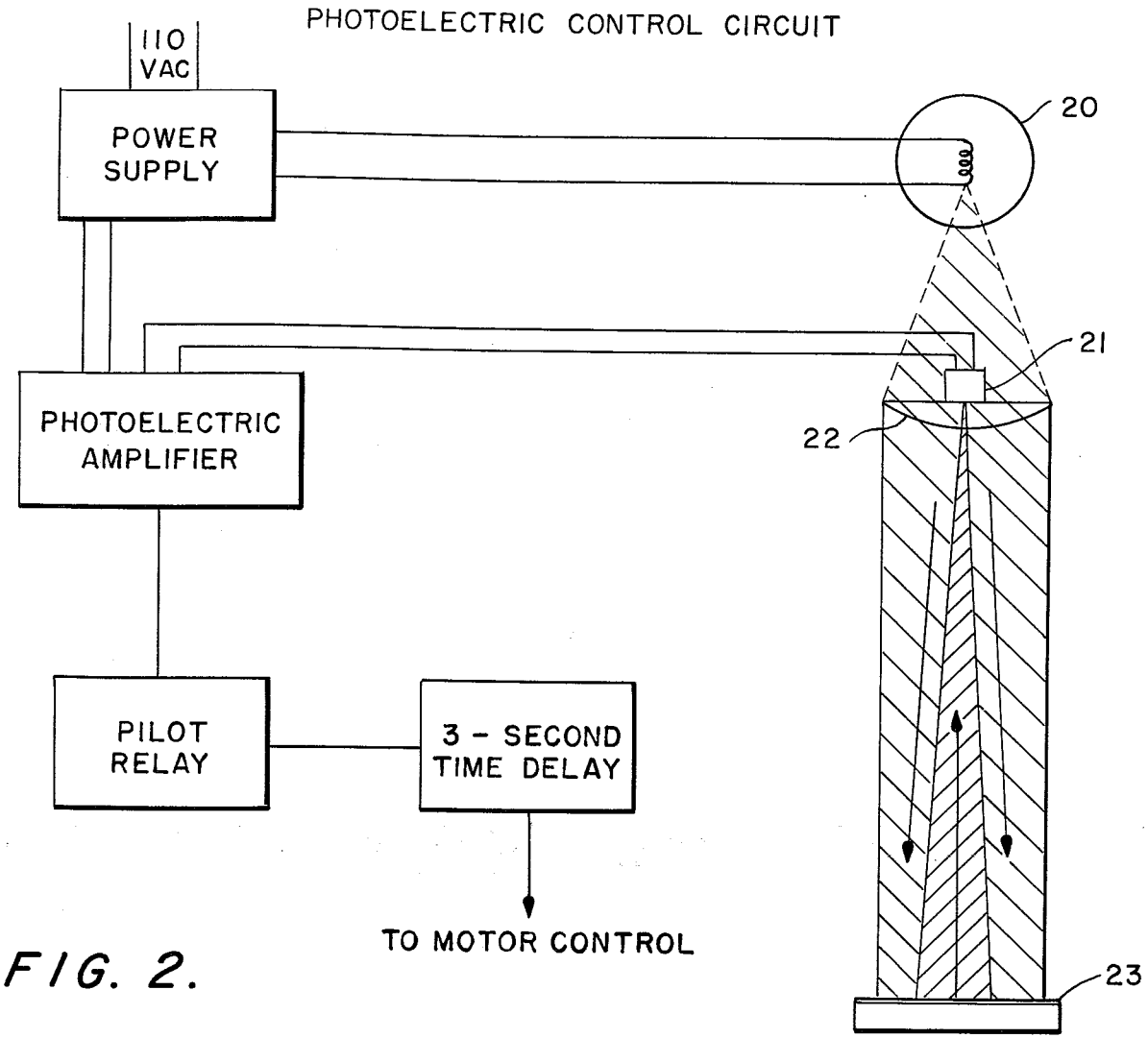
FIG. 2 is a block diagrm of one of the light sensitive detecting circuits.

FIG. 2 shows one of the two identical detector control circuits in block diagram. Only one of the two circuits for the side-by-side photocell detectors will be described since the other is the same. Both share a common light source 20. The common light source 20 and the photoelectric cells 21 as well as a lens 22 are in each of the units forming the detector 3 of FIG. 1. Assuming only one concentrate, light would be shown on either side of line 11 between the concentrate and a nonconcentrate zone. Sensors shown as the photoelectric amplifier of FIG. 2 receive a signal from the cells 21. If a fluctuation is detected relative to a predetermined normal condition for line 11 a signal is sent by the sensor. Depending on the signal received, a relay will be actuated to cause the motor to drive the splitter in either of two directions until the cells indicate a predetermined normal condition again. The triggering of the amplifier circuits can be accomplished by any type of bistable amplifier circuitry. Not all fluctuations of the concentrate zone will or should drive the splitter. Variations in light frequency or intensity reflected from the concentrate zone 23 caused by shaking of the table 9 are compensated for by a built in delay in the circuitry. In the example shown a three second time delay was used to eliminate actuation of the motor drive by unwanted signals from the sensor.

Once activated the straight edge 12 of the splitter (FIG. 1) is moved to continuously position itself near and aligned with the line 11 at the recovery edge of the table. In this manner the concentrated material that it is sought for reuse is split off from the undesired nonconcentrated slurry which may then be discarded. For example, tests run by the Bureau of Mines show that by properly selecting the cut point for the splitter edge 12 relative to the concentrate zones a percentage of pyrite concentrate of 88 percentage could be recovered from a sample having an initial 34.4 percent pyrite concentration. Details of the actual tests run and other details of this invention may be found in the Apr. 3, 1972 Bureau of Mines Report of Investigation R. I. 7623.

Other details of the apparatus used in the preferred embodiment include an overhead hood suspended three inches over table 9 (FIG. 1) to cover the photocells 21, lenses 22 and light 20 to protect the sensors from damage and shield the target area from excessive ambient light. A wire running along support 18 can be used to connect the photoelectric amplifiers in the control 2 to the sensors. Pilot relays, also in the control, (FIG. 2) are used to actuate motor starters to provide the forward and/or reverse direction to the motor. In the working embodiment shown the motor 6 is a one-fourth horsepower reversible gear motor. The splitter 4 can also be considered a combined diverting chute that directs the recoverable concentrate into a final product collecting container.

The two photocells 21 used were of the cadmium selenide type with a peak spectral response at a wavelength of 7,350 A (angstrom units) which lies in the orange-red portion of the visible spectrum. The actual photocell used was a semiconductor that had a variable resistance which changed as a function of the intensity of the impinged light reflected from the color zone. By properly selecting the type of photocells that are sensitive to given wavelengths ($\lambda$) or frequency ($f$) the best sensors can be found for the particular concentrate to be recovered. For example, suppose the concentrate had an orange color in the 6,000 A range with a frequency of about $10^{14}$–$10^{15}$ hertz per second ($\lambda = 300{,}000/f$). At least one photocell would be selected to be responsive to frequencies in this range but not in the nonconcentrate frequency. The other photocell would be responsive to frequencies in the nonconcentrate adjacent color zone but not the concentrate. By initially focusing the cell response to the concentrate frequency on the adjacent nonconcentrate zone 23 and the cell responsive to the nonconcentrate frequency on the concentrate zones shifts to the responsive zones will actuate one of the cells. As used herein the terms intensity and frequency may be used interchangeably.

Power is supplied to the FIG. 2 photoelectric amplifier by an integral 24 volt d.c. full wave rectifier that has its input from a 110 voltage a.c. standard source. As the resistance input to the photoelectric amplifier varies, there is an adjustable triggering value in the amplifier that actuates it. This value corresponds to an increase or decrease in frequency from the cell. Depending on the color of the concentrate and nonconcentrate zones a decrease or increase in reflected light frequency will ultimately actuate the motor in either a forward or reverse direction.

When actuated, the mobile splitter 4 and its attached platform 19 move in the directed direction at a speed of about 1 inch per second. The tracks 8 are formed of elongated inverted angle irons fixed to the platform and the rollers 5 may be grooved castors which move on them. The legs of the platform 19 may be adjustable to coincide with the slope of table 9 and thus insure the detector 3 is moved in a plane parallel to the surface containing the color zones.

Figure 3:
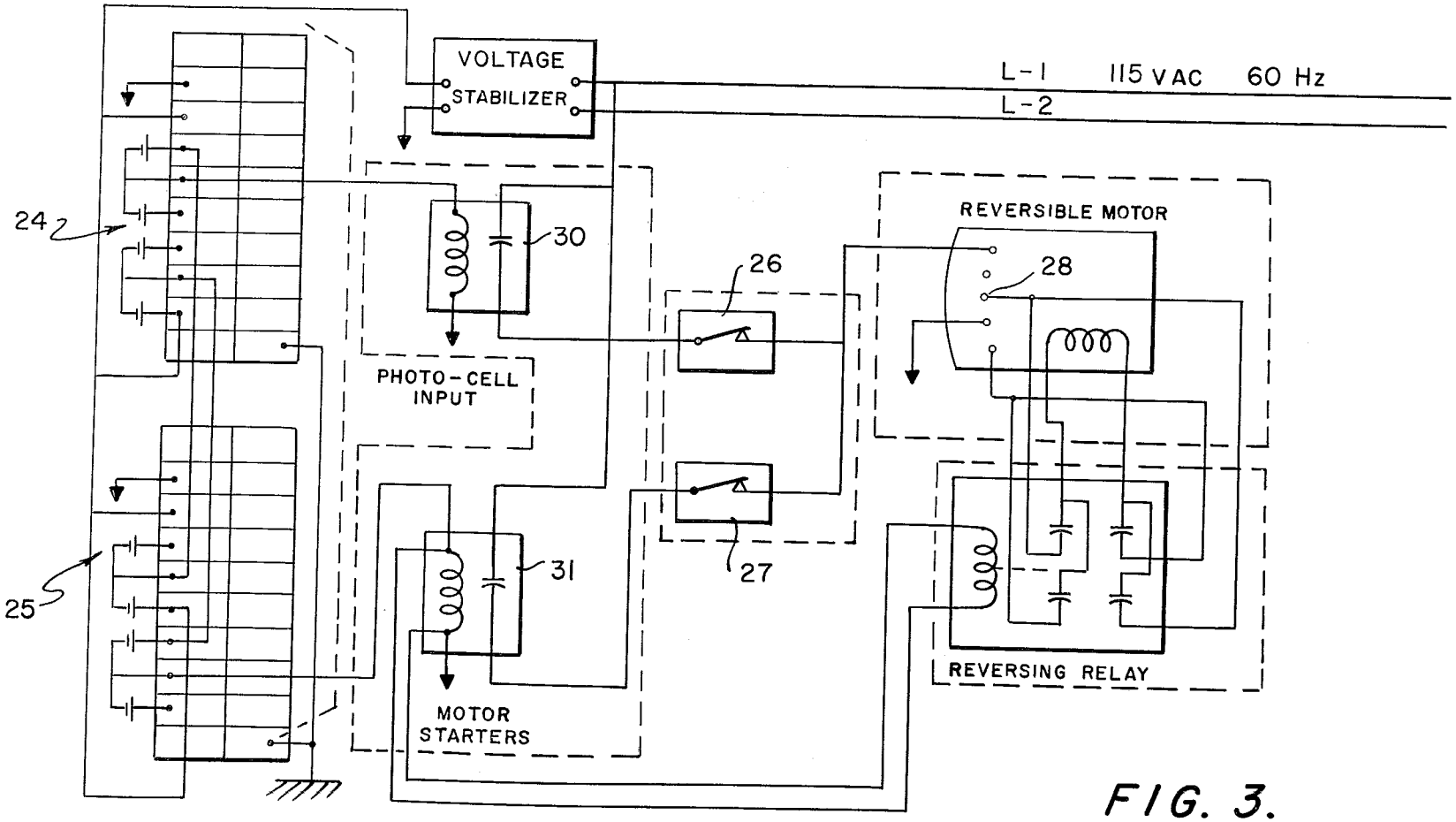
FIG. 3 is a diagram of the mobile splitter drive circuit.

FIG. 3 is a more detailed diagram of the wiring diagram used to control the movement of the mobile splitter. The boxes numbered 24 and 25 correspond to the pilot relays of FIG. 2. An interlock insures that both cannot be actuated simultaneously by a signal from one of the photoelectric amplifiers. The voltage stabilizer powers the phtoelectric units and the line voltage (115 volts a.c. and 60 Hz) is directly supplied to the two identical motor starters circuits 30 and 31. Two normally closed limit switches 26 and 27 shut off power to the reversible motor, shown in dotted lines in the right side of FIG. 3, in case of malfunction.

These limit switches are in the platform stops 29 (FIG. 1) and are opened if the platform 19 and its attached splitter move too far in either direction.

The operation of the preferred embodiment and its set up will now be described. First, a color zone is chosen as the normal condition. In that case the detector 3 and the splitter edge 12 are properly placed to insure the maximum amount of concentrate is split over to the collecting container. Then each of the two photocells are set such that their respective photoelectric amplifiers will be actuated when they vary from this normal condition. One cell is chosen to be actuated as the light frequency reflected from the material color zones increases and the other is to be actuated as the frequency decreases. By visually relating the location of the different cells to the variations of the normal condition of the color zone material, the direction that the platform is to be moved can be predetermined i.e., if the cell responsive to increasing or decreasing reflected frequency is triggered the reverse or forward motor (or vice versa) will be actuated until the normal condition reappears. Both cells have their electrical resistance changed because of variations in light frequency or intensity. Usually if the cell is responsive to more intensity then its resistance will decrease and the current through it increase. Likewise, if responsive to less light intensity, the resistance will increase and its current decrease. Whatever the case, each cell feeds one and only one of the two motor starters 30 and 31. As shown in FIG. 3, starter 30 actuates what has been called the forward direction of the motor and starter 31 the reverse direction. Suppose more light intensity on one cell triggers the cell circuit connected to starter 30, then less light intensity would trigger the reverse starter 31. In any event, it is the variations in the current received from relays 24 and 25 in the starter coils that closes the normally opened parallel contacts of the starters. This closing will in turn, by the circuit with limit switches 26 and 27, actuate one of the motors. For example, if starter 31 is actuated then its coil in the reversing relay would also be actuated to close normally opened contacts to the reversible motor. This would result in the motor draft spinning in an opposite direction until the variations in current through the starter coil in starter 31 cease or the limit switch 27 is actuated. In a like manner the actuation of forward starter 30 by its associated photocell causes the motor to spin in a forward direction until stopped.

It is thus seen that what we have provided is an apparatus which detects variations in reflected light from materials previously segregated by some characteristic quality like density and uses this information to either take no action (if the variations are less than 3 seconds) or cause movement of a mobile material splitter attached to a platform. By associating a forward or reverse direction with the light intensity variations from a normal condition, the flow stream is constantly monitored by the detectors so that the splitter is always in a position to recover the maximum concentrate.

While two photocell detectors have been shown to move the splitter in two opposite directions it should be apparent that more cells electrically connected could be employed to relate different parts of the stream to a plurality of different splitters to simultaneously monitor many materials on a concentrating table. This could be done by making the splitters and detectors move in parallel planes to their respective counterparts. In this way the splitters would be able to simultaneously recover several different concentrates from the same stream.

Further, while a wet concentrating table has been illustrated as the primary separator to visually indicate the concentrate of a material or materials, other devices may also be used. One such other device is a Humphrey's spiral which uses sluicing and centrifugal action to differentiate different densities of materials. Heavier particles would, in this type of spiral, stay on the inside of the spinning spiral with the lightest particles remaining on the outside.

None of the specific disclosed features of the preferred embodiment should be used to limit the scope and extent of our invention which is to be measured only by the scope of the claims that follow.

We claim:

1. A material separating apparatus for separting a concentrate from the material comprising:

a primary material separator means having a surface with a recovery end for initially separating out a concentrate from the material and to visually indicate the concentrate on its surface;

a secondary material separator operatively associated with said primary separator at its recovery end to separate and recover said concentrates based on a characteristic quality of its reflected light;

said secondary separator including a light responsive detecting means to monitor the concentrate on the primary separator surface, a material separator and recovery means, and a control drive interconnecting between them whereby the material separator of the secondary separator is capable of being moved in response to variations on the monitored concentrate on the primary surface as a function of the characteristic quality of the detected reflected light.

2. The apparatus of claim 1 wherein said characteristic quality of reflected light is color and said detecting means comprises:

a plurality of photocells with each cell connected to means for sending a signal when detected light color varies from a preestablished normal condition.

3. The apparatus of claim 2 wherein at least one of said plurality of photocells and its means for sending a signal is responsive to increases in the frequency of the reflected light waves from the concentrate.

4. The apparatus of claim 2 wherein at least one of said plurality of photocells and its means for sending a signal is responsive to decreases in the frequency of the reflected light waves from the concentrate.

5. The apparatus of claim 1 wherein said light responsive detecting means and material separator of said secondary separator move together as a unit and are interconnected.

6. The apparatus of claim 1 wherein said primary material separator is an inclined wet concentrating table comprising:

means for vibrating the surface to move material over a series of surface protrusions; and means for applying a liquid to the surface.

7. The apparatus of claim 1 wherein said control includes a reversible power means capable of moving said secondary material separator in opposite directions depending on the characteristic quality of the detected reflected light.

8. The apparatus of claim 7 wherein said detecting means, material separator and recovery means, and control move as a unit on a rolling platform located adjacent the recovery end of said primary separator surface.

9. The apparatus of claim 8 wherein said primary separator is an inclined wet concentrating table whose recovery end is below and parallel to said detecting means.

10. The apparatus of claim 9 wherein said detecting means comprises a light source, a plurality of photocells aligned side-by-side and a lens for focusing said reflected light from the concentrate.

11. The apparatus of claim 1 wherein said light responsive detecting means and material separator of said secondary separator move together as a unit based on the detected reflected light.

* * * * *